US005655767A

United States Patent [19]

Francis et al.

[11] Patent Number: 5,655,767

[45] Date of Patent: Aug. 12, 1997

[54] MOVABLE PLAYER FOR BOARD GAME

[75] Inventors: Geoffrey V. Francis, Oakville; Stephen W. Pendry, Thornton, both of Canada

[73] Assignee: Vision Games, Inc., Canada

[21] Appl. No.: 669,438

[22] PCT Filed: Jan. 5, 1995

[86] PCT No.: PCT/CA95/00011

§ 371 Date: Jul. 2, 1996

§ 102(e) Date: Jul. 2, 1996

[87] PCT Pub. No.: WO95/18656

PCT Pub. Date: Jul. 13, 1995

[30] Foreign Application Priority Data

Jan. 7, 1994 [CA] Canada ..... 2 113 042

[51] Int. Cl.[6] ..... A63F 7/06

[52] U.S. Cl. ..... 273/108.1; 273/108.51; 273/317.3; 446/330

[58] Field of Search ..... 273/317.1, 317.2–317.6, 273/108.1, 108.2, 108.21, 108.22, 108.3, 108.32, 108.4, 108.51, 108.52, 108.53, 108.54, 108.56; 446/330, 331, 333, 334, 335, 336

[56] References Cited

U.S. PATENT DOCUMENTS

| | | | |
|---|---|---|---|
| 2,229,232 | 1/1941 | Widegren et al. | 273/85 |
| 2,431,552 | 11/1947 | Gosnell | 273/85 |
| 3,810,622 | 5/1974 | Payne, Jr. | 273/85 |
| 3,811,674 | 5/1974 | Trvovich et al. | 273/85 |
| 3,856,303 | 12/1974 | Payne, Jr. | 273/85 |
| 4,146,224 | 3/1979 | Deutsch | 273/85 |
| 4,304,405 | 12/1981 | Laine | 273/108.51 |
| 4,976,434 | 12/1990 | Wikner | 273/85 |
| 5,040,794 | 8/1991 | Albrecht | 273/85 |
| 5,046,734 | 9/1991 | Laine | 273/85 |
| 5,299,967 | 4/1994 | Gilbert | 446/288 |
| 5,393,058 | 2/1995 | Rowland et al. | 273/108.22 |
| 5,449,171 | 9/1995 | Makhoulian | 273/108.22 |

FOREIGN PATENT DOCUMENTS 800015 8/1958 United Kingdom .

*Primary Examiner*—William M. Pierce
*Attorney, Agent, or Firm*—Baker & Daniels

[57] ABSTRACT

A board game for simulating a sport such as basketball or ice hockey in which the game board has a flat playing surface on which can be moved a number of playing members that can manipulate a small object such as a puck or ball. Each member includes a main body portion extending upwardly from the playing surface and an object manipulating portion pivotally connected to the body portion. A flexible line can be used to pivot the manipulating portion relative to the body portion. Each member has a short vertical shaft that extends through a slot in the game board and a first gear is mounted on the bottom end thereof. Horizontal rod mechanisms are used to move the members along their respective slots. The rod mechanism comprises a hollow tube on which a second gear is fixedly mounted. This second gear is arranged to turn the first gear when the tube is turned about its axis. The line extends through the tube and there is a sliding control member at the outer end of the tube for pulling the line. The playing members disclosed herein can also be used to make board games simulating such games as soccer, baseball and cricket.

19 Claims, 10 Drawing Sheets

MOVABLE PLAYER FOR BOARD GAME

This invention relates to board game apparatus including game boards requiring playing members to be moved over the surface of the boards by control rods.

A variety of board games are known which require a number of playing pieces to be moved about the playing surface of the game board, often by means of some mechanical control mechanism such as a movable rod. In many of these games, the playing members are colored or otherwise designed to represent two different teams of playing members. A well known game board of this type simulates the game of ice hockey and, in this particular game, there are five regular playing members on each team plus a goalie member that can be moved to protect the goal net from an incoming shot. In this game a small puck-like disc can be used and is movable around the board by the playing members.

U.S. Pat. No. 5,046,734 issued Sep. 10, 1991 to Klas I. Laine illustrates a table hockey game wherein each playing member can be moved along a slot by means of a control rod or actuator shaft. In this known game, two of the hockey players on each side are movable to and from positions behind the goal nets. This is because their slots are curved and bend about 90 degrees near one corner of the playing surface. As in previously known games of this type, the playing members can be rotated about a vertical axis by rotation of the actuator shaft about its longitudinal axis.

U.S. Pat. No. 3,856,303 issued Dec. 24, 1974 to Tudor Games, Incorporated describes a game apparatus designed to simulate a basketball game. It also has a plurality of playing pieces that are movable along the playing surface by push rods slidably disposed under the game board and adapted to be operated at each end of the board. A basket-like device is arranged at each end of the board and is elevated above the playing surface. Small ramps are arranged on the board and these are used in conjunction with the playing pieces to raise the ball upwardly from the board in the general direction of the basket.

U.S. Pat. No. 4,976,434 issued Dec. 11, 1990 to *Stiga Aktiebolag* describes a table game apparatus designed to simulate a baseball game. This game includes a number of playing figures mechanically rotatably arranged on the playing surface for catching and forwarding a ball to base areas. There is disclosed in this patent specification a playing member that can be rotated by means of a rotation of a control rod that is enclosed by an axially movable control tube that extends through a hole in the side wall of the game board. The tube is used to operate a bell crank lever which is biased to a desired position by means of a spring. By pivoting the bell lever one is able to swing a rocker body inwardly, thus allowing a ball to be caught between the arms of the body and held there by a magnet.

According to one aspect of the invention, a board game apparatus comprises a game board with a generally flat, upwardly facing playing surface, a number of game playing members adapted to manipulate a small object for movement over and above said surface, each playing member including a body portion that extends upwardly from said playing surface and an object manipulating portion pivotally connected to said body portion, means for pivoting said manipulating portion relative to said body portion, vertical shaft means extending from each of the body portions and down through the playing surface for rotatably mounting the respective body portion on the playing surface, a number of substantially horizontal rod means provided for moving said playing members along respective slots formed in the playing surface, means for engaging each rod means with a respective vertical shaft means so that rotation of each rod means about its longitudinal axis causes a corresponding rotation of the shaft means engaged therewith, and means for rotatably supporting each rod means below the playing surface, the apparatus characterized by each rod means comprising a rotatable hollow tube and the pivoting means including an elongate member extending through the tube, wherein rotation of each hollow tube about its longitudinal axis rotates its respective playing member about a generally vertical axis.

According to a further aspect of the invention, a combination movable playing member and control mechanism therefor suitable for a board game comprises a main body section and a pivotable section connected to the main body section, the two sections comprising the playing member, a shaft extending downwardly from said main body section and sized to extend through a hole in a game board for said game, elongate tube means for moving said playing member relative to the game board, means for engaging said tube means with the shaft so that rotation of the tube means about its longitudinal axis causes a corresponding rotational movement of the shaft, said combination characterized by said shaft being hollow and by a flexible control line extending through the tube means and the shaft and into the main body section, the line being connected at its inner end to the pivotable section and having means located at the other end of the tube means to enable the control line to be pulled.

The game apparatus disclosed herein can be adapted to simulate a variety of sports-related games including basketball, hockey, football, soccer, baseball and cricket. In the case of a game apparatus of the invention constructed to simulate basketball, a playing member on the simulated basketball court can be controlled to move horizontally across the game board, turn or pivot and raise arms. Because the arms can be raised or lowered, they can be used to block a ball, catch a ball, and to throw or shoot the ball. The players are manipulated by rods or tubes located under the playing surface in a manner similar to known, simulated ice hockey games. However, in a preferred embodiment, the arms of a playing member can be raised by pulling on a control button arranged at the outer end of that player's control tube. This in turn pulls a control wire or line which raises the arms to an elevated position.

In an ice hockey version of the invention, at least the regular playing members are constructed so that they can simulate the well known slap-shot used in a regular ice hockey game. This is possible because each playing member has a manipulating portion which can be pivoted about a horizontal axis in a manner which permits this portion to strike an adjacent puck device or disc. Because of this pivoting action, it is possible to actually lift the puck device off of the playing surface and to more accurately control the power and direction of both passes and shots on goal.

In a preferred form of the board game, the slots in the game board are arranged in a particularly advantageous manner. Each half of the game board has at least five elongate slots extending generally in the lengthwise direction with two of these being formed on the left hand side of a longitudinal center line, two being formed on the right hand side and the fifth slot being formed in the region of the center line itself. At least one of the left hand slots and at least one of the right hand slots are formed with bends in central longitudinal regions of the slots so that two adjacent playing members arranged to move along either the left hand slots or the right hand slots can move closer together or further apart along the central regions and can interact one another in these central regions when they are closer to each other. This permits the playing members to "tackle" one another and to take the puck or ball away from the opposing playing member.

A game board apparatus constructed in accordance with the invention can be made to more accurately simulate the real sport game. Moreover, the game board apparatus of the present invention can be made in an inexpensive manner to keep the costs of the game reasonable.

There is also disclosed herein a preferred construction for a game board for a game requiring playing members to be moved on the board. The game board is made of two principal sections that are detachably connected to produce a complete board with a playing surface. A number of slots for movement of the playing members are formed in each of these principal sections, these slots being located in a horizontal panel portion. The slots extend to an inner edge thereof so that the slots are open-ended at this inner edge. The sections are connected together at the inner edges of the panel portions and there are means for rigidly connecting these sections together. In a preferred embodiment, the two principal sections can be substantially identical so that a single mold can be used to produce both sections, thus keeping mold costs down. This game board construction also make it easier for a purchaser of the game to assemble the game himself and attach such items as control rods and figurines.

Further features and advantages will become apparent from the following detailed description taken in conjunction with the accompanying drawings.

Figure 1:
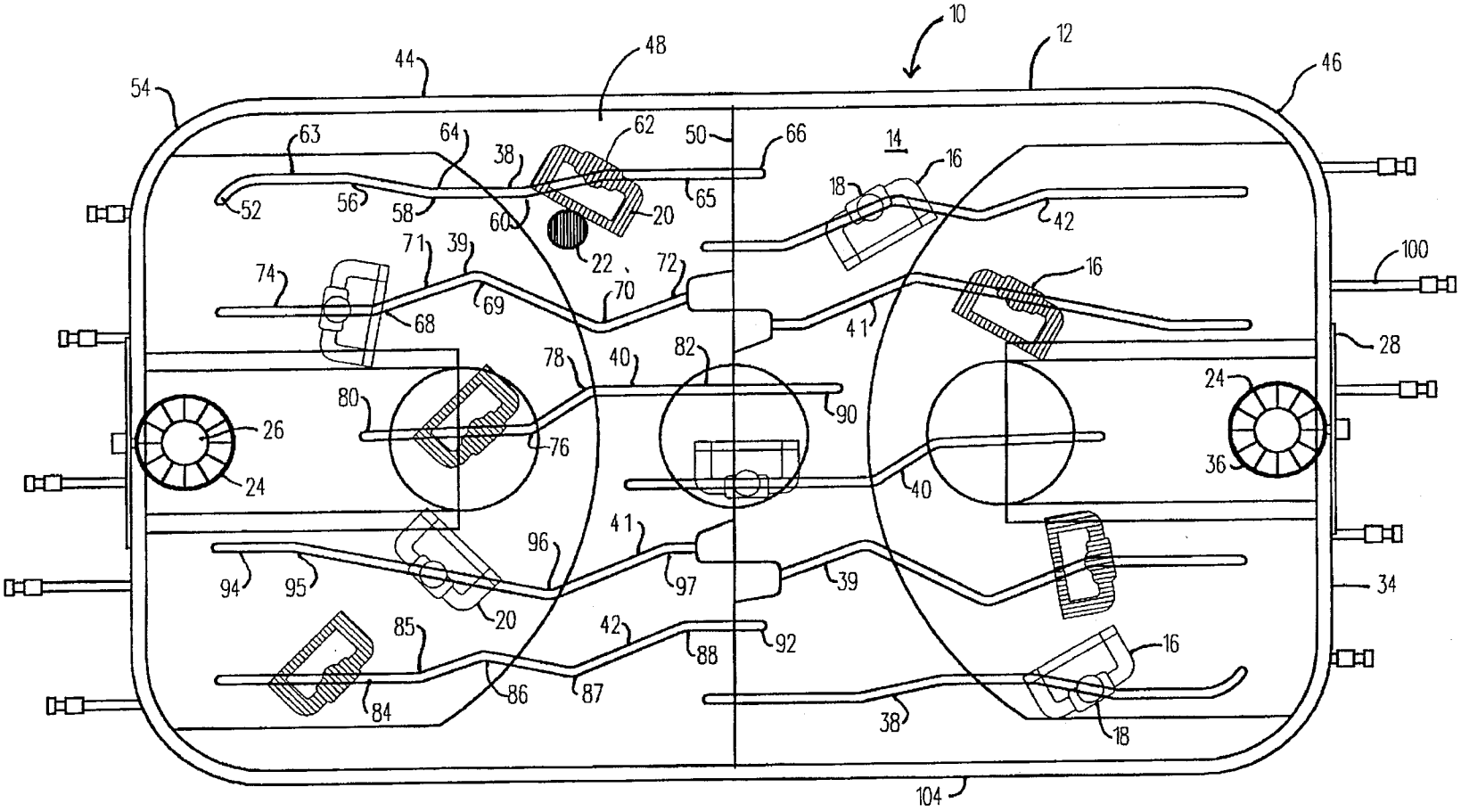
FIG. 1 is a plan view of a board game apparatus constructed in accordance with the invention, which apparatus simulates a basketball court.
Figure 3:
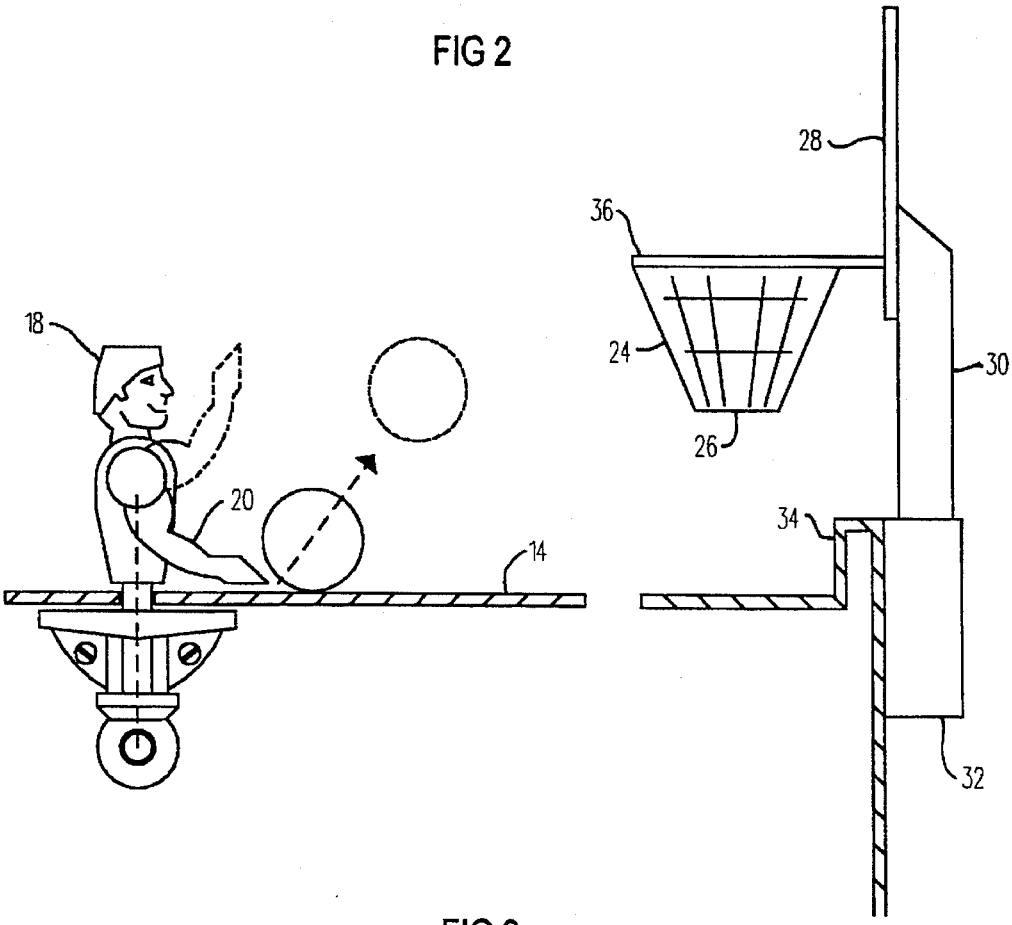
FIG. 3 is another sectional detail, in elevation, illustrating how the playing member of FIG. 2 can be used to lift and shoot a ball towards a net device.

FIG. 1 illustrates a board game apparatus 10 constructed in accordance with the invention and laid out in the manner of a basketball court. The apparatus comprises a game board 12 having a generally flat, upwardly facing playing surface 14. A number of game playing members 16 are mounted on the playing surface and are capable of being moved parallel to the playing surface or horizontally in order to play the game. These playing members preferably depict a human figure or a partial figure, in this case a basketball player. As explained in more detail hereinafter, each playing member includes a body portion 18 that extends upwardly from the playing surface and an object manipulating portion 20 pivotally connected to the body portion 18. As explained hereinafter, there are means for pivoting the manipulating portion 20 relative to the body portion. In the case of the illustrated game apparatus, the object to be manipulated is a small ball that may depict or simulate a basketball. The object of this basketball game is to shoot the ball 22 through one of two basket members 24. Each of these basket members has an open bottom 26 that enables the ball 22 to fall through the basket member in the same manner that it does in a real basketball game. The basket members are located at two opposite ends of the game apparatus and they are elevated above the playing surface 14 as shown in FIG. 3. Preferably, each basket member is mounted on an upright, rigid panel 28 which can act as a backboard against which the ball can be bounced. The panel 28 is supported on an upright post 30 which in turn is supported by a centrally located post support 32 that can be formed on or attached to an end wall 34. It will be understood that the support 32 forms a socket with an open top and a closed bottom with the socket sized to closely accommodate the post 30.

The preferred ball 22 is a small, sponge rubber ball that is light enough to be lifted by the playing member 16. The ball would normally have a diameter of 2 inches or less and in one preferred embodiment the diameter is about 1 inch. Of course, the diameter of the ball must be significantly less than the diameter of the rim 36 of the basketball net. The diameter would normally be slightly less than the diameter of the opening 26 in the bottom of the net device. The preferred form of the ball is made from low density sponge rubber.

A number of slots 38 to 42 are formed in the game board 12 to allow for movement of the playing members 16. In the illustrated preferred embodiment of FIG. 1 there are five main slots 38 to 42 in each of two principal sections 44 and 46 that make up the game board. These two half sections are detachably connected in a preferred embodiment to complete the game board. The slots are formed in a horizontal panel portion 48 of each section and they preferably extend to an inner edge 50 thereof so that the slots are open-ended at this inner edge. At least the majority of the slots 38 to 42 extend a major portion of the length of their respective principal section. In each of these sections, two slots 38, 39 are formed on the left hand side of the longitudinal center line of the section and two slots 41, 42 are formed on the right hand side of this longitudinal center line. The fifth slot 40 is formed in the region of the longitudinal center line.

In a preferred embodiment of the simulated basketball game, the two left hand slots 38, 39 and the two right hand slots 41, 42 are formed with bends forming obtuse angles in their central longitudinal regions. In particular, the slots are so formed that two adjacent playing members either in the left hand slots or the right hands slots can come closer together along the central regions compared to other slots regions on opposite sides of the central regions and can contact one another in the central regions. This arrangement of the slots is to improve the "flow" and play of the game. With this slot arrangement, each playing member has an area of safe-haven where he cannot be tackled or effectively blocked by another playing member of the opposite team. For example, with the playing member moving along the slot 38 these safe-havens would be at end regions of the slot 38 located near the corner of the court and in the area of the center of the court. However, in order for the playing member to move from the safe-haven area, the member must enter an area where it can be "tackled" or blocked.

With respect to the particular slot configuration used in the embodiment of FIG. 1, the slot 38 has a short curved section 52 near a rounded corner 54 of the game board and large obtuse angles formed by bends at 56, 58 and 60. There is a fourth bend forming a large obtuse angle at 62. With these bends, the slot has three straight sections 63 to 65 which are in substantially parallel alignment. It will be further noted that the slot 38 has a short extension at 66 which is formed in the other half section 46. The slot 39 has three bends forming obtuse angles at 68 to 70 with the bends at 69 and 70 being shown as sharper than those in the slot 38 but it will be understood that these two bends could form larger obtuse angles. The sections of the slot 39 at 71 and 72 can be in substantially parallel alignment while an initial section 74 of the slot extends parallel to the longitudinal center line of the section.

With respect to the central slot 40, the preferred slot has two bends at 76 and 78 which form obtuse angles. As a result, slot end sections at 80 and 82 are in parallel alignment and are parallel to the longitudinal center line of the section 44 or 46.

The outer slot 42 has an initial straight section 84 and then there are four slight bends 85 to 88 forming large obtuse angles. Both the central slot 40 and the slot 42 have end extensions 90 and 92 formed in the opposite half section 46. The inner right hand slot 41 has a relatively short, straight initial section 94 and three bends 95 to 97 forming large obtuse angles. Preferably the five main slots in the other half section 46 are formed and laid out in a similar manner as shown and these slots also have some slot extensions in the half section 44.

Figure 5:
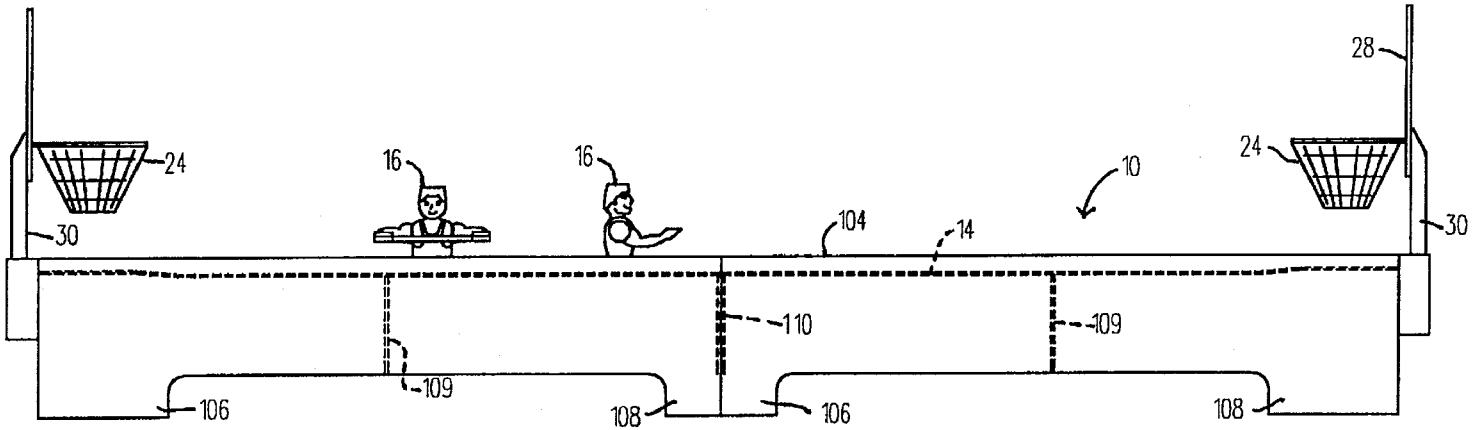
FIG. 5 is a side elevation showing a preferred form of the game board of FIG. 1 but omitting the control rod mechanisms and a number of the playing members for ease of illustration.

Also shown in FIG. 1 are a number of substantially horizontal rod means 100 which are provided for moving the playing members 16, there being one rod means for each playing member. In the illustrated basketball game there are five such rod means projecting from each end of the game board and it will be understood that these rod means extend through openings formed in each end wall of the game board, these openings being similar to the openings shown in FIG. 19. In order to help keep the rubber ball on the playing surface, the surface 14 is surrounded by an upwardly extending perimeter wall 104, a portion of which is formed by the end walls 34, one of which is illustrated in FIG. 3. Preferably the perimeter wall 104 extends downwardly from the playing surface as illustrated in FIG. 5. Each principal section can be formed with short supporting legs 106 and 108 to elevate the playing surface a suitable distance above the ground or table on which the apparatus is supported. Preferably, the playing support surface is further supported by transversely extending ribs indicated at 109 and 110. These ribs must be formed with suitable openings below the playing surface to permit the passage of the movable rod mechanisms 100.

Figure 2:
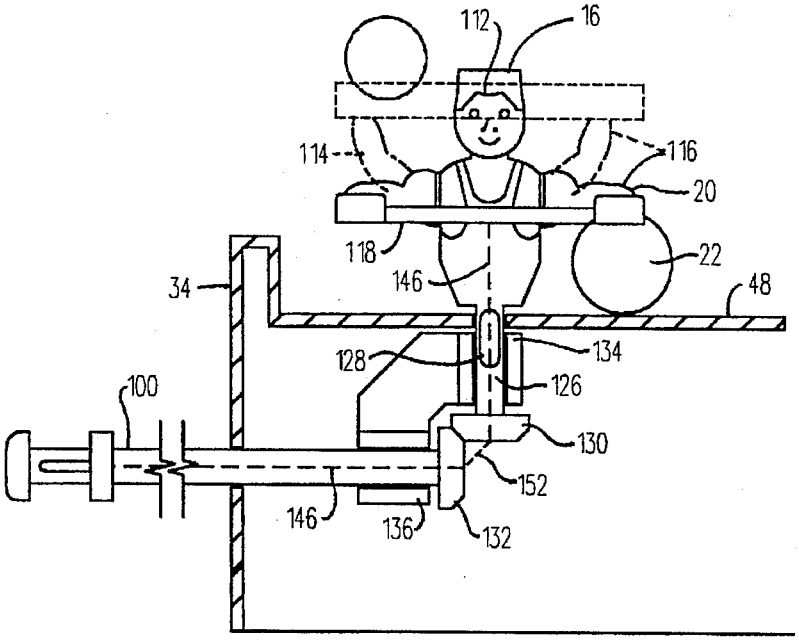
FIG. 2 is a sectional detail in elevation illustrating a playing member for a simulated basketball game and a rod control mechanism therefor.

Turning now to the basketball playing member illustrated in FIGS. 2 and 3, the body portion 18 can be shaped to correspond to the shape of the upper portion of a human player, including a suitably shaped head 112. The manipulating portion 20 includes two spaced-apart arm sections 114 and 116, a ball engaging section 118 extending between and connecting the two arm sections at their outer ends, and a horizontal shaft section 120 shown in FIG. 6. The section 120 extends between and connects the arm sections at their inner ends and it has two non-circular end sections 121 and 122 which are fitted into correspondingly shaped holes 123 formed in the arm sections. The ball engaging section 118 is substantially straight and it has an elongate recess 124 formed in its upwardly facing surface to make ball manipulation easier.

Extending downwardly from the body portion 18 is vertical shaft means 126 and it is this shaft which extends down through the playing surface via the respective slot. The playing member is pivotably mounted by means of this vertical shaft. The shaft, which is hollow, preferably is formed with two or more vertically extending slots 128, which slots are designed to provide a shock absorbing capability. By providing this capability, contact between the playing members is less likely to cause damage to the playing member or its support. These slots 128 should not be unduly large so that they will not weaken the shaft to such an extent that it could fail during play of the game.

Figure 10:
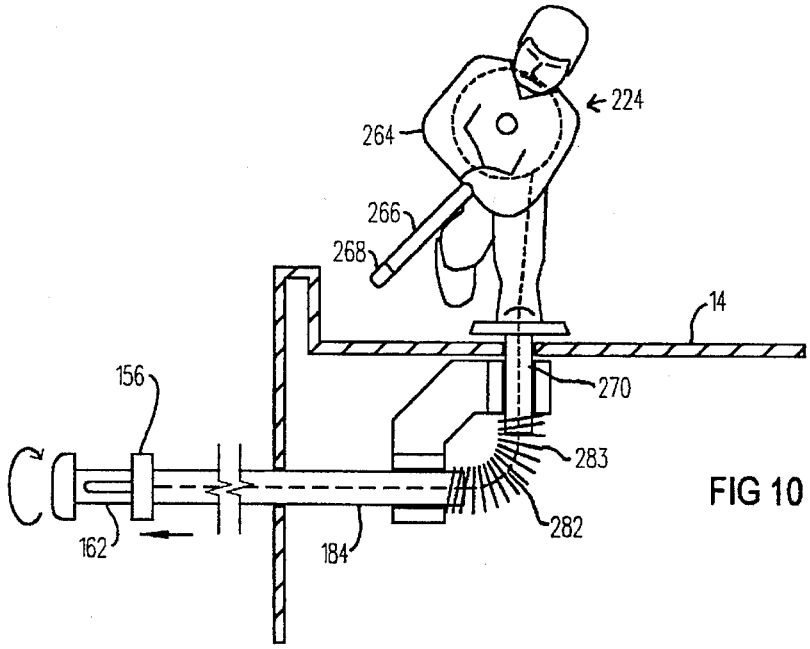
FIG. 10 is a detail view, in elevation, illustrating one of the playing members for the game apparatus of FIG. 9 and the rod control mechanism therefor.
Figure 11:
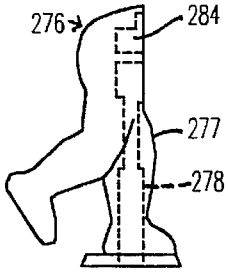
FIG. 11 is a side elevation of a main body section of the playing member of FIG. 10.
Figure 12:
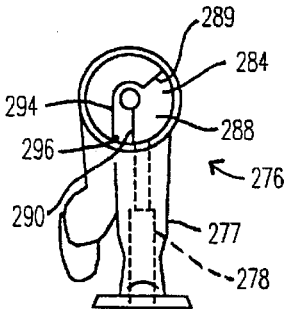
FIG. 12 is a front elevation of the main body section of FIG. 11.
Figure 13:
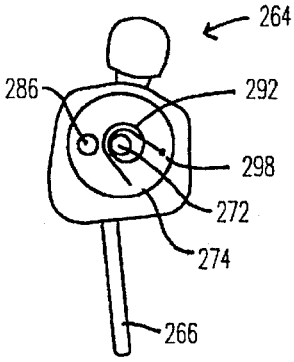
FIG. 13 is a rear elevation of a pivotable body section that is connected to the main body section of FIGS. 11 and 12.
Figure 14:
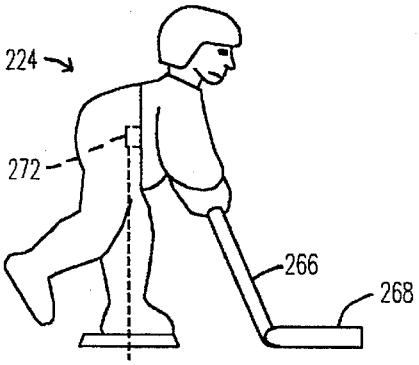
FIG. 14 is a side elevation of the playing member of FIG. 10 but omitting the vertical shaft that extends downwardly therefrom and the control mechanism.

Mounted on the bottom end of the shaft means 126 is a first gear 130, preferably a bevelled gear. Each preferred rod means 100 includes a hollow tube and a second gear 132, also preferably a bevelled gear, is fixedly mounted on the inner end of this tube. The second gear operatively engages the first gear of the respective playing member. As detailed hereinafter, instead of using the gears 130 and 132 to turn the axis of rotation, one can instead use a bent coil spring in a known manner to accomplish the same objective (see FIG. 10 of the drawings). Arranged between the shaft 126 and the tube is a tube support member 134, the details of which can be seen from FIG. 4. This member has a short passageway 135 located in a sleeve portion 136 and it is through this passageway that an inner end section of the tube 100 extends. The tube is free to rotate in this passageway. An angle portion 137 connects the bottom portion 136 to the shaft embracing section 138. The section 138 forms a vertical passageway at 140 through which the shaft means 126 extends. The shaft embracing section 138 is made from two halves which are detachably connected together by means of small bolts or screws 142. Outwardly extending arms 144 are formed on one half of the section 138 and these help keep the shaft means 126 and its playing member vertical.

In order to operate and pivot the manipulating portion 20, a flexible control line 146 is used and this line extends through the tube or rod 100, through the bevel gears 132, 130, through the vertical shaft means 126 and up into the main body portion 18. The line 146 is connected at its inner end 148 to the pivotable body portion 20 and in particular to the aforementioned shaft section 120 which is formed with a cantilever arm 150. A preferred form of the control line is one molded from acetal, a plastics material which will not shrink if it becomes wet. Because the line is molded, it can be formed with an end knob at one or both ends to help secure the line to the connecting part. One such knob is shown at the end 148 of FIG. 6. Furthermore, the control line 146 can be molded with a thinner section 152 in the region of the line where the line bends upwardly between the inner end of the tube or rod and the vertical shaft and the remainder of the line can be made substantially thicker to permit ease of handling in the assembly of the control mechanism. The thinner section 152 can be no more than 1 mm thick and, in one preferred embodiment, it has a diameter of 0.030 inch (0.75 mm). The thicker portions of the line could, for example, be cross-shaped in cross-section and have a transverse dimension of 6 mm with a 1 mm leg thickness.

Figure 4:
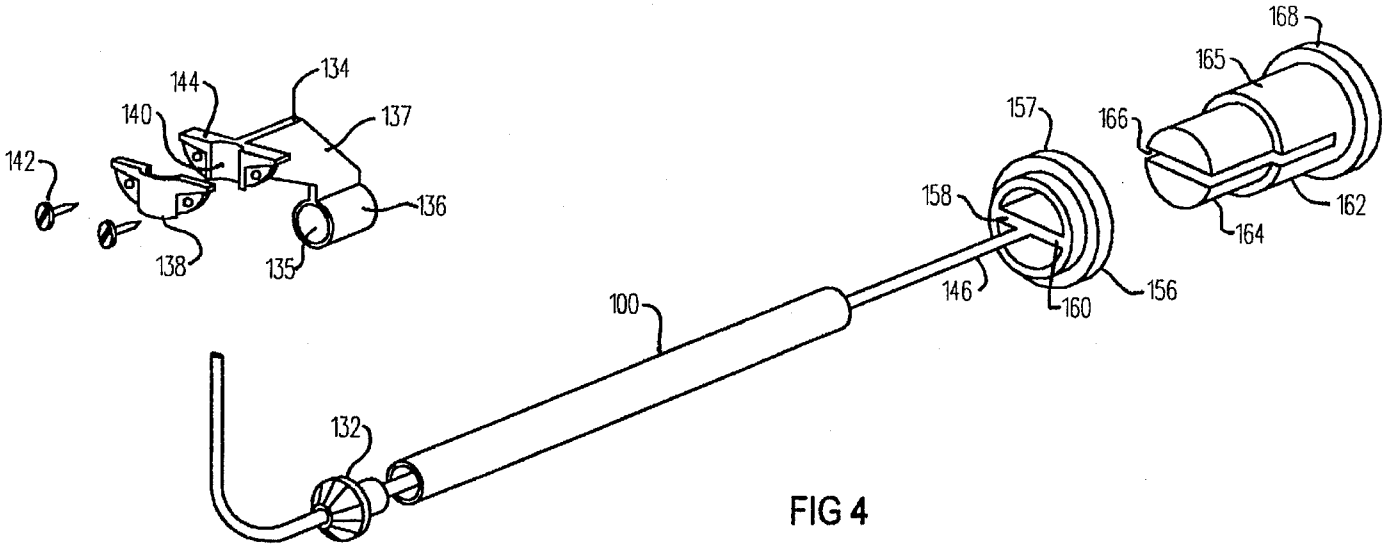
FIG. 4 is a blown apart perspective view showing the control rod mechanism and a support member for holding up the inner end thereof.

There are means located at the outer end of the tube means 100 to enable the control line 146 to be pulled. A preferred form of enabling means is illustrated in FIG. 4 and it includes a movable hob 156 which can be formed with a circumferential rim 157 that can be readily grasped by a player's fingers. The center of this knob is hollow with a cylindrical passageway extending axially through it at 158. One end of this passageway may be split by a diagonally extending cross-piece 160 which connects the line 146 to the knob. The hob 156 is adapted to slide on the outer cylindrical surface of a short guide member 162. This member 162 is fixedly connected to the outer end of the tube or rod 100 by means of a connecting portion 164 which is of reduced diameter as compared to a longer, central section 165 on which the knob 156 slides. The diameter of the portion 164 corresponds closely to the internal diameter of the tube 100 and adhesive may be used to connect these two members. Both portions 164 and 165 are split by a longitudinally extending slot 166 into which the cross-piece 160 can slide. The guide member 162 is also formed with an end flange 168 so as to permit this member to be easily grasped between two fingers. It should be noted here that both the tube 100 and the control line can vary in length depending upon the particular playing member that they are designed to control. For example, typically the tube 100 could vary in length from 385 mm to 744 mm.

Figure 6:
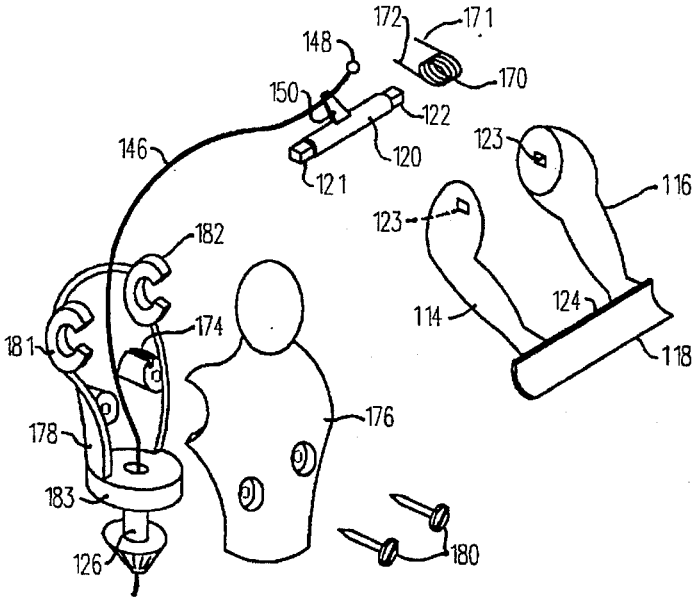
FIG. 6 is a blown apart view, taken in perspective, showing parts of a preferred form of playing member for the board game of FIG. 1.

Shown in FIG. 6 is a spring biasing means in the form of a small coil spring 170. It will be understood that this coil spring fits over one end of the shaft section 120 and its inner end 171 is secured at a suitable location to this shaft section. Its outer end 172 is suitably secured to the main body section of the playing member, for example, in a slot 174 formed inside this body section. The spring is provided to bias the pivotable body section of the player to the lowered position, that is so that the ball engaging section 118 is immediately adjacent the playing surface. The player's arms can be raised by simply pulling on the movable knob 156 the desired amount. Upon release of this knob, the arms and the section 118 will return to the lowered position.

A body section for a basketball player is illustrated in FIG. 6 and it includes a frontal section 176 and a rear section 178, these two sections being detachably connected by means of small bolts or screws 180. The rear section 178 is formed with two, spaced apart C-shaped holders 181 and 182 adapted to support and secure the rounded portions of shaft section 120 which will snap into these holders. The rear section 178 is also provided with a circular base portion 183 which rests on the playing surface of the game board. The vertical shaft 126 is rigidly attached to the center of this base portion.

Figure 7:
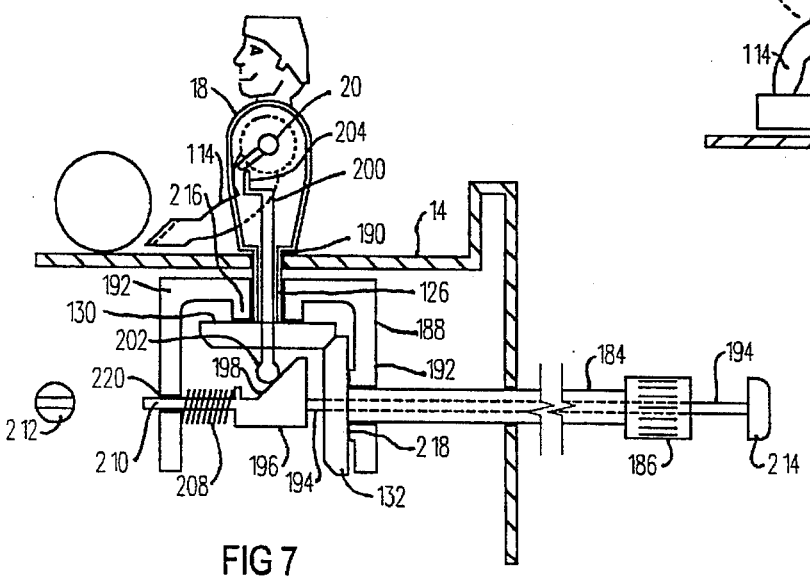
FIG. 7 is a sectional view, in elevation, of an alternative form of playing member and control mechanism for the board game of FIG. 1.
Figure 8:
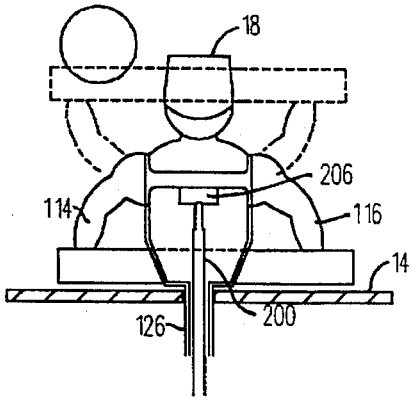
FIG. 8 is a sectional detail, in elevation, showing the playing member of FIG. 7 from the front.

FIGS. 7 and 8 illustrate an alternative construction for the controlling mechanism for each basketball playing member. The same reference numerals will be used to indicate components of the playing member that are constructed in substantially the same manner as that shown in FIGS. 2 and 6. There is a ball manipulating portion 20 having arm sections 114 and 116. The manipulating portion 20 is pivotally connected to a main body portion 18 which can rotate about a vertical axis defined by vertical shaft means 126. Fixedly mounted on the bottom end of this vertical shaft is a first bevelled gear 130 which engages a second bevelled gear 132 mounted on an inner end of a tubular member 184, a portion of which is broken away for sake of illustration. A knurled sleeve 186 can be fixedly mounted on the outer end of member 184 to permit easy rotation of the tubular member about is longitudinal axis. The inner end of the tubular member is rotatably supported by means of a Y-shaped support member 188 having tubular upper extension 190 sized to slide easily in a slot formed in the panel that forms playing surface 14. The Y-shaped member 188 has two downwardly extending support arms 192.

In this alternative embodiment, the means for pivoting the manipulating portion of the playing member relative to the body portion 18 includes a straight, elongate first rod member 194 which extends through the tubular member 184 and out both ends thereof. A ramp member 196 with an inclined upper surface 198 is connected to the inner end of the rod 194 and is positioned below the respective playing member. A second vertically extending rod member 200 extends between the inclined upper surface 198 and the manipulating portion 20 whereby axial movement of the first rod member 194 is converted into vertical movement of the second rod member in order to pivot the manipulating portion. The second rod member 200 extends through the center of the vertical shaft 126. It may be formed with an enlarged, rounded bottom end 202 and it may be formed with an elbow 204 at the top to enable it to engage a forwardly inclined lever 206 which is located inside the main body portion 18 and midway between the arm sections 114 and 116.

A coil spring 208 extends around a cylindrical, central section of the ramp member and rests against one of the arms 192 at one end. This spring biases the ramp member and the attached rod to the right as seen in FIG. 7. The ramp member 196 is further supported by the left arm 192 by means of a short flat-sided extension 210 extending through a matching hole in arm 192. The extension 210 is non-circular in cross-section in order to prevent rotation of the ramp member 196. An end cap 212 can be used to secure the extension 210 in the hole 220. Preferably the outer end of the first rod member 194 is fitted with a hurled hob 214 to permit easy manipulation by the user's fingers. Rotation of the tube 184 about its axis will rotate the gears and thereby cause rotation of the playing member about a vertical axis. Also, by pushing the rod member 194 inwardly, one can cause the playing member to lift its arm sections and the attached ball engaging section.

Note that the second rod member 200 should be made with a non-circular cross-section or vertically extending ribs so that it cannot rotate about its longitudinal axis in the vertical shaft 126. Of course, the central passageway extending through the shaft 126 must have a corresponding non-circular cross-section. Also, preferably a spacer or sleeve such as those indicated at 216 and 218 should be used to space the wide end of each bevel gear from the adjacent surface of the Y-shaped support member. Although most of the described embodiments can be made from a suitably strong plastics material, the vertically extending rod member 200 could be made of a stronger material such as a suitable metal.

Figure 9:
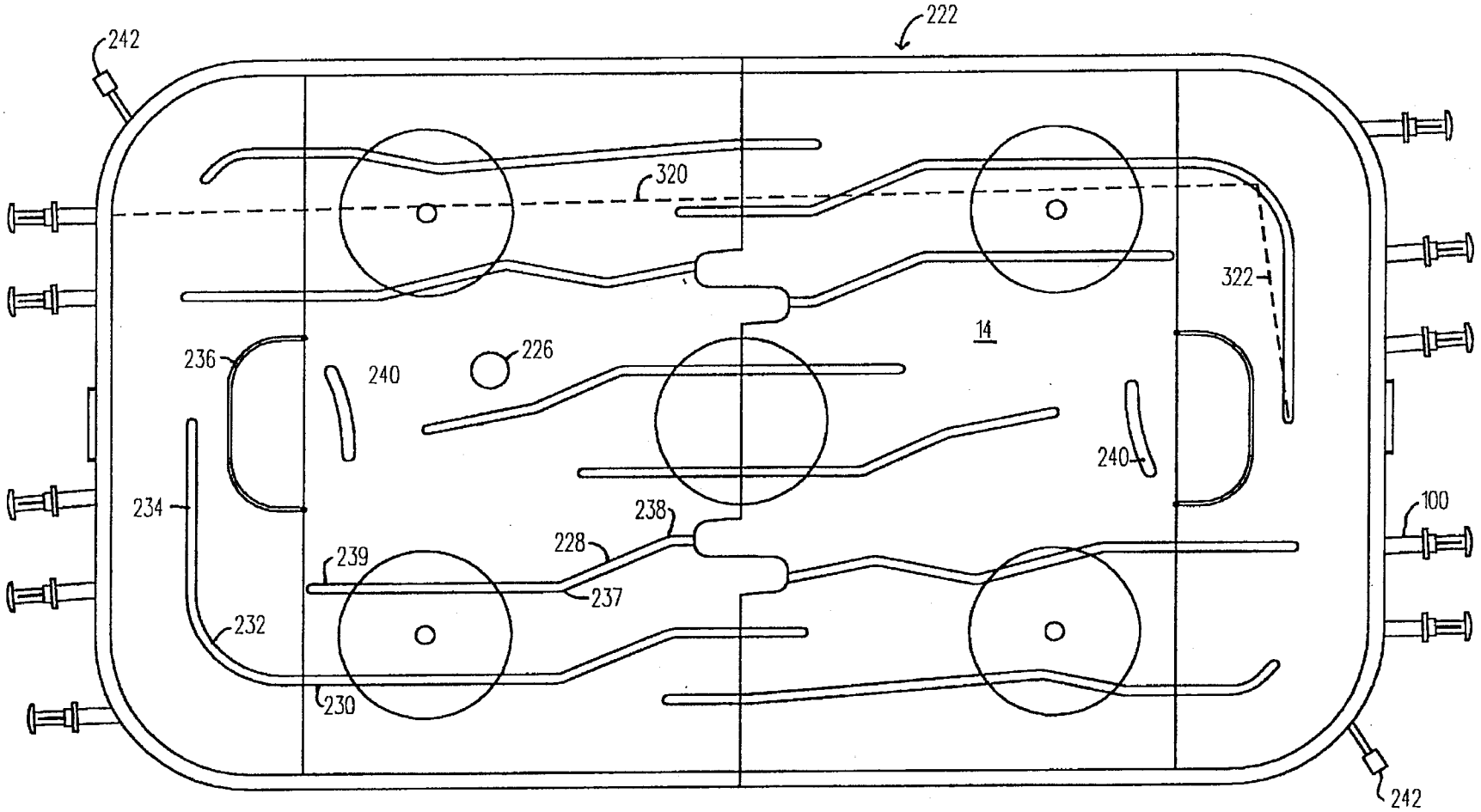
FIG. 9 is a plan view of another board game apparatus constructed in accordance with the invention, this particular apparatus being constructed to simulate the sport of ice hockey.
Figure 18:
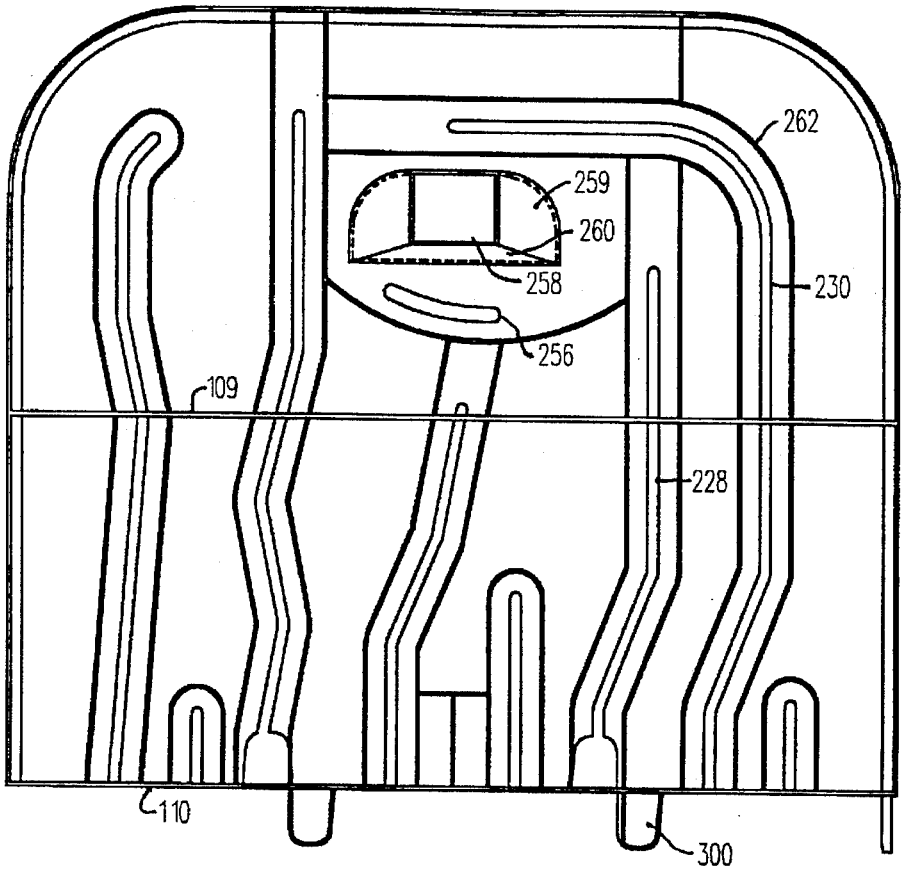
FIG. 18 is a bottom view of the game board apparatus of FIG. 9.
Figure 19:
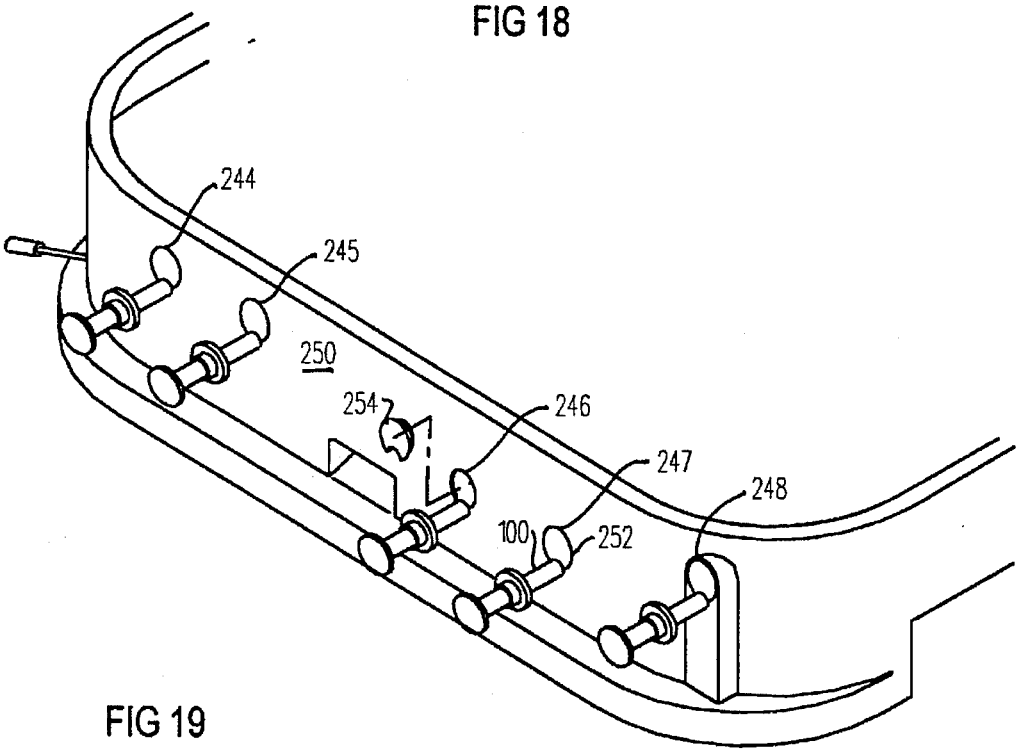
FIG. 19 is a perspective view from above of an outer end of the board game apparatus of FIG. 9.

The present invention can also be incorporated into a board game designed to simulate the sport of ice hockey and the game board for such a game is illustrated in FIGS. 9, 18 and 19. The hockey game board 222 is in many respects similar to the basketball game board described above and the same reference numerals will be used to indicate components which have the same or similar construction. Thus, the hockey game board has a flat, upwardly facing playing surface 14 on which a number of playing members 224 (see FIGS. 10 to 14) can be moved in order to manipulate a small object 226 which can be a disc or puck-shaped member having two, opposing flat sides. The board has a number of elongate slots formed therein for guiding the movement of the playing members 224 and, except for the differences noted hereinafter, these slots can be generally arranged in the same manner as already described in connection with the game board 12 of FIG. 1. It will be noted that the right hand slots 228 and 230 are somewhat different in the ice hockey version of the game. In the case of the long slot 130 on the extreme right, it has a rounded 90 degree bend 232 near the adjacent outer end of the board. This bend leads to an end section 234 that extends substantially parallel to the adjacent outer end of the board and that is behind simulated hockey net 236. The slot 228 has only two bends at 237 and 238, both forming large, obtuse angles. A long, straight section 239 of this slot extends to a point at the rear of the net 236. Some contact between the playing members of these two slots is thus permitted to the rear of the net.

Unlike the basketball game, the ice hockey game is provided with an extra slot 240 at each end of the playing surface in front of the simulated hockey net. A suitable goalie member is movable in each of these slots by means of an extra control rod mechanism 242 located in the region of one of the adjacent corners of the game apparatus. The goalie member can be constructed in a similar manner to goalie members used in rod hockey games used in the past and it of course can be configured to have the appearance of a hockey goalie, i.e. thick pads along the legs and a wider hockey stick. Thus, the control rod mechanism 242 can be a simple control rod or tube with no control line passing therethrough. In the alternative, it could be constructed in a similar manner to the other playing members but configured to have the appearance of a goalie.

FIG. 19 illustrates on end of the game board apparatus and shows a number of keyhole like apertures 244 to 248 formed in end wall 250 to hold and support the five rod means 100 that are used to control and operate the five playing members (apart from the goalie member) that form one team. The apertures 244 to 248 are formed with a large circular top section at 252 sized to permit passage of the larger end portions of the rod means during assembly of the game. The bottom portion of each aperture is narrower and sized to snugly accommodate the tube of the rod means which can be pushed into this portion. After connection of the rod means, a suitable button member 254 can be pushed into the top section 252 to hold the rod means in the bottom portion of the aperture.

FIG. 18 shows one half of the bottom of a preferred game board apparatus for a hockey game. The five long slots formed in the horizontal panel include the aforementioned slots 228 and 230. FIG. 18 also illustrates an alternative slot construction 256 for the goalie member wherein the slot is simply a curved arc spaced in front of the location for the goal net. In the embodiment of FIG. 18 there is a rectangular opening 258 located in the bottom of the goal net through which the puck may pass when a goal is scored. Areas in front of and to the side of the opening 258 indicated at 259 and 260 can be sloped, if desired, to ensure that the puck passes through the opening.

FIG. 18 illustrates how the region around the slots in the playing surface can be strengthened by means of ribs 262 located on both sides of each slot and spaced therefrom. If the playing surface is made from a plastics material, these ribs can be easily molded onto the bottom of the panel forming the playing surface.

Turning now to a form of playing member for a hockey game, which is shown in FIGS. 10 to 14, the playing member 224 has a manipulating portion 264 which includes an elongate bent member 266 having an end section 268 extending parallel to the playing surface 14. The elongate-bent member 266 of course simulates a standard hockey stick used in ice hockey. It will be noted that the member 266 is located entirely on one side of the vertical axis extending through the shaft 270 that extends through the game board. A short pivot pin 272 projects from a round vertical side 274 of the manipulating portion, which side is located away from the bent member 266. The portion 264 is pivotally mounted on a main boy portion 276 which can be configured to simulate the lower body and legs of a hockey player. Extending through one of these legs 277 is a passageway 278 through which the control line 282 extends. The control line can be similar in its construction to the previously described control line 146. In one preferred embodiment, the line passes through the center of a first gear 130 and a second gear 132 (as illustrated in FIG. 2). The second gear is mounted on the inner end of tubular member 184. In the alternative embodiment shown in FIG. 10, the control line 282 passes through a bent coil spring 283 which is used in a known fashion to connect the tubular member 184 to the shaft 270. Thus, in this version, the spring 283 provides the means for turning the axis of rotation 90 degrees or substantially 90 degrees. The control line is operated in the same manner as already described in connection with FIG. 4. Thus, one pulls on the movable knob 156 in order to pull the control line 282. A small spring 292 mounted in the cavity 284 biases the stick or bent member 266 to the lower position shown in FIG. 14. Thus, by pulling on the control line 282, a player can raise the member 266 to the position shown in FIG. 10. Projecting from the circular vertical side 274 is a pin member 286 to which the control line 282 is connected and which acts as a stop to limit the pivotal movement of the manipulating portion 264. This pin member 286 projects into a deeper section 288 of the cavity in the main body portion, the deeper portion being sector shaped and extending between radially extending cavity walls 289 and 290. The spring 292 is positioned in shallow recess 294 which extends generally vertically to the base of the cavity 284. One end of the spring can be mounted in a small hole 296 located at the bottom of recess 294. The other end of the spring can be fixed in a small hole 298 located at one side of the side 274 of manipulating portion 264.

It will thus be seen that, unlike previously known board games simulating ice hockey, the playing members of the present game have a third action which enables the playing member to perform a shot similar to the so called "slap-shot" in regular ice hockey. This action allows a playing member to lift the puck or disc off the playing surface 14 and to more accurately control the power of passes and shots. This unique capability of at least the regular playing members 224 can result in a faster and more realistic hockey board game.

In a preferred embodiment, the bent member 266 is made from a suitable metal to give it added strength and some flexibility.

Figure 15:
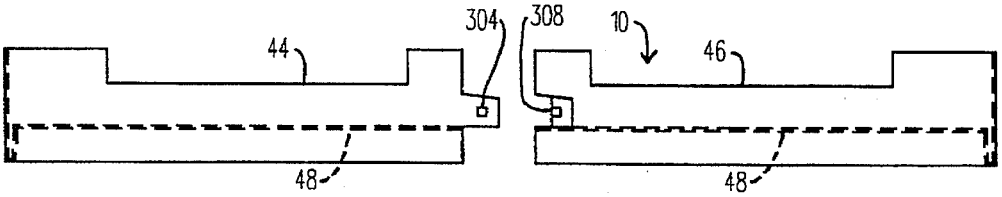
FIG. 15 is a side elevation of a preferred form of game board made from two half sections that can be detachably connected together, which half sections are shown in a detached position.
Figure 16:
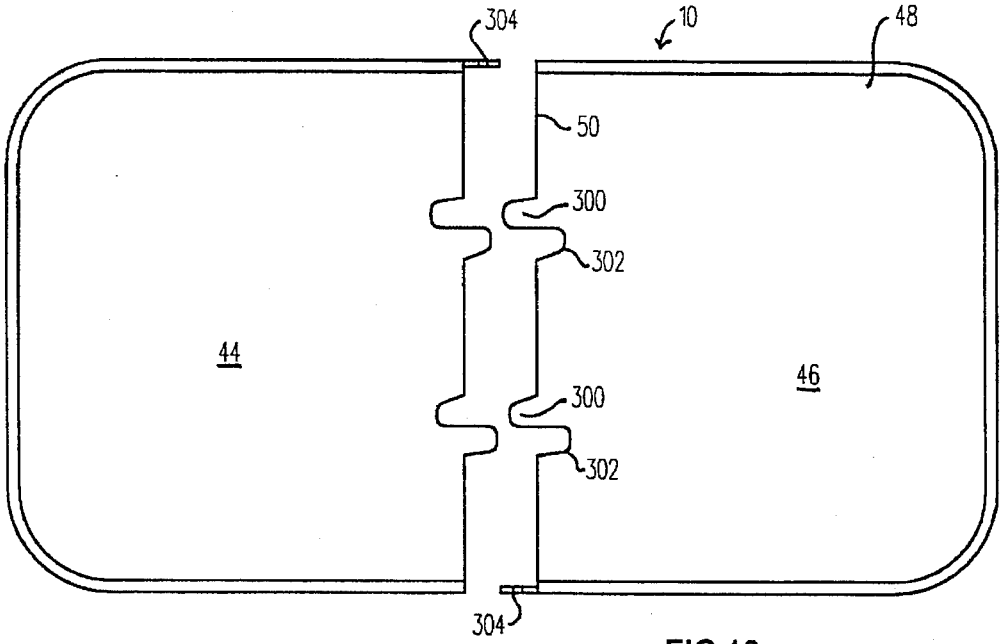
FIG. 16 is a plan view of the two half sections of FIG. 15 showing the use of two panel tongues on each half section which are used to securely connect the sections together.
Figure 17:
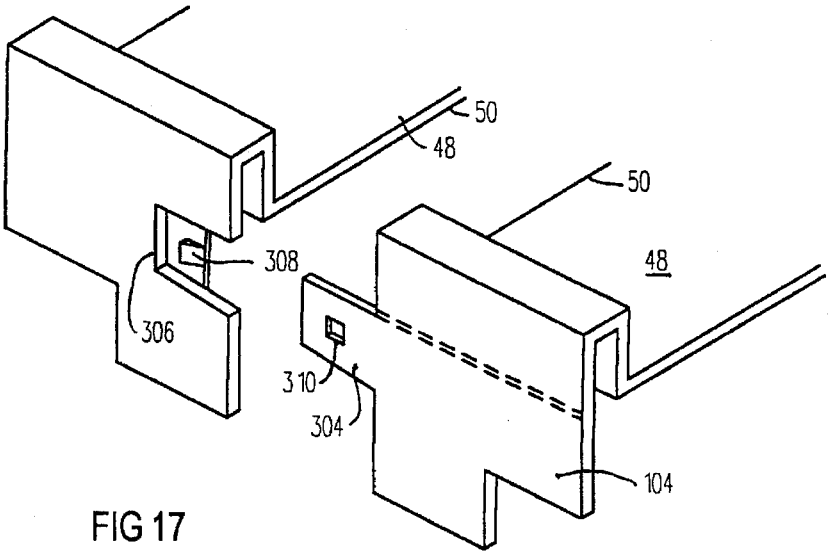
FIG. 17 is a detail view, in perspective, showing one preferred form of attachment mechanism for the aforementioned two half sections.

A preferred construction for the board game apparatus 10 is illustrated in FIGS. 15 to 17 of the drawings. As explained, the board game preferably comprises two principal sections 44 and 46 which are detachably connected to produce the complete game board. The slots (not shown in FIG. 16 for ease of illustration) are formed in a horizontal panel portion 48 of each section and these slots extend to the aforementioned inner edge 50 so the slots are open-ended at this edge. The sections are connected together at their inner edges and there are means for rigidly connecting the sections together.

In the illustrated preferred embodiment, each horizontal panel portion 48 has at least two panel tongues 300 projecting horizontally from the inner edge thereof together with at least two recessed edge sections 302 also in the inner edge 50. These tongues and recessed edge sections form part of the connecting means with the tongues of one panel portion 48 interengaging the recessed edge sections of the other panel portion. It will be appreciated by one skilled in the art that these tongues and recessed edge sections help to prevent relative transverse movement of one game board section relative to the other.

The connecting means for the two sections preferably also include a tongue member 304 formed at an inner end of one of the support walls 104 adjacent the inner edge of the panel portion and a further recess 306 adapted to receive the tongue member 304 on the support wall of the other principal section. The recess 306 is formed at an inner end of this support wall. Located in this recess is a small ramp like projection 308 which is adapted to snap into a rectangular hole 310 formed in the tongue member 304. It will be appreciated that the tongue 304 and recess 306 prevent relative vertical movement of one principal section with respect to the other and the engagement between the projection 308 and the opening 310 holds the two sections together in a detachable manner.

Figure 20:
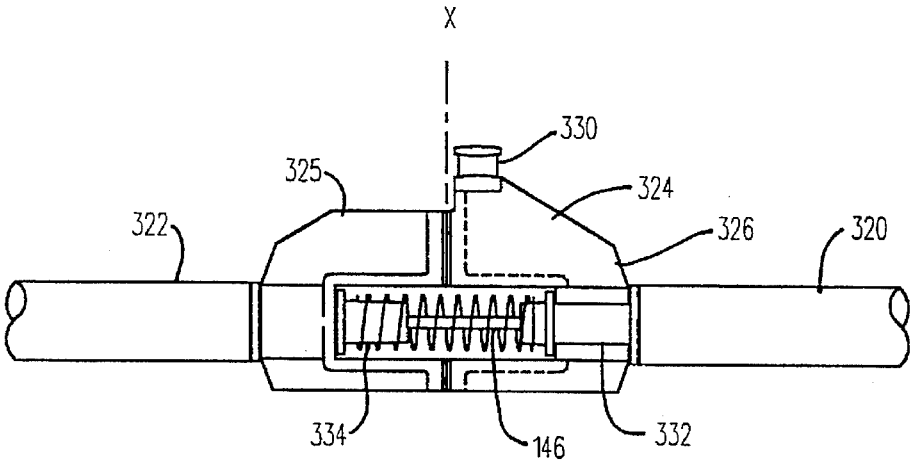
FIG. 20 is a detail elevation showing how two rod sections can be connected together so as to permit the rod control means to bend around a corner in a slot.
Figure 21:
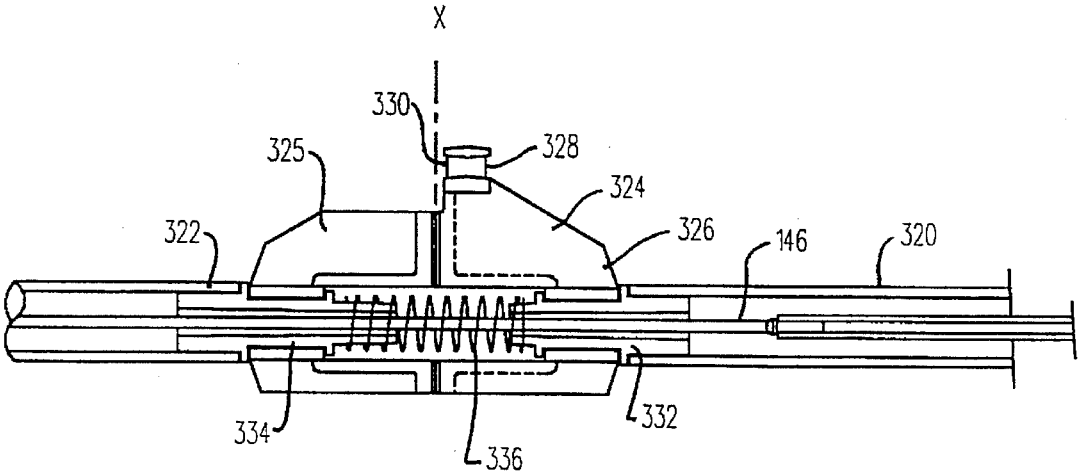
FIG. 21 is a detail elevation similar to FIG. 20 but providing an axial cross-section through the rod sections.

In the preferred embodiment of applicant's rod hockey game as illustrated in FIG. 9, the playing members that are moved along the two slots 230 which have a 90 degree bend at 232 employ a special rod means which is able to bend at the 90 degree bend. The bending mechanism for these particular playing members is illustrated in FIGS. 20 and 21 of the drawings. In FIG. 9, the relative lengths of the two rod sections 320 and 322 that make up this bendable rod means are illustrated by the dashed line which ends at the farthest position of the playing member located directly behind the opponent's goal net. In one preferred embodiment of applicant's game, the long section 320 is 744 mm measured from the outer end of the tube member to its inner end while the shorter section 322 is 111 mm measured between the two ends of the tube. Of course, the length of the rod sections actually used will depend upon the dimensions of the game board chosen.

Turning now to FIGS. 20 and 21, the two rod sections are connected together by means of a specially designed hinge member 324 made up of two pivotally connected parts 325 and 326. Rigidly connected to the top-of part 326 is guide member 328 having a groove or slot 330 on each side thereof. It will be understood that the edges of the slot 230 fit into the grooves 330 and the guide member 328 is free to slide along the slot. It will be understood that the member 324 bends about a vertical axis X.

Flanged sleeve members 332 and 334 are rotatably mounted in passageways formed in the member 324. The sleeve member 332 is rigidly connected to the inner end of rod section 320 while the sleeve member 334 is rigidly connected to the adjacent end of rod section 322. The adjacent ends of the two sleeve members are pivotally connected together by means of a coil spring 336 which extends through the vertical axis X. As shown clearly in FIG. 21, the flexible control line 146 extends through the coil spring 336 and through each of the sleeve members 332 and 334. It will be understood that because the sleeve members 332 and 334 are rotatable, rotation of the rod section 320 about its longitudinal axis is transmitted via the coil spring 336 to the rod section 322 in order to rotate the latter.

It will be understood that the rules for playing the simulated hockey game with the apparatus of the invention can be similar to the rules for the sport of ice hockey or similar to the rules for previously known rod hockey games. Similarly the rules for the game of simulated basketball played with the apparatus of FIGS. 1 to 8 can be similar to the rules for regular basketball, modified to take into account the more limited degree of movement of the playing members 16 as compared to regular human players. It will be appreciated that the basketball game of the invention can simulate closely the play, strategy and excitement of regular basketball. By raising the arms of the playing members, these members can be used to block, tackle, dribble, throw and shoot the ball. Using suitable modified playing members constructed in accordance with the invention, it is possible to develop and construct other board game simulating sports such as baseball and cricket, the rules for which would be similar to those of the actual sport. For example, playing members constructed in accordance with the invention can be made to represent and act like a cricket batman or a cricket bowler. In the case of a baseball board game, they can be made to represent and act like a batter and/or pitcher, and even like fielders in the case of a large game.

Figure 22:
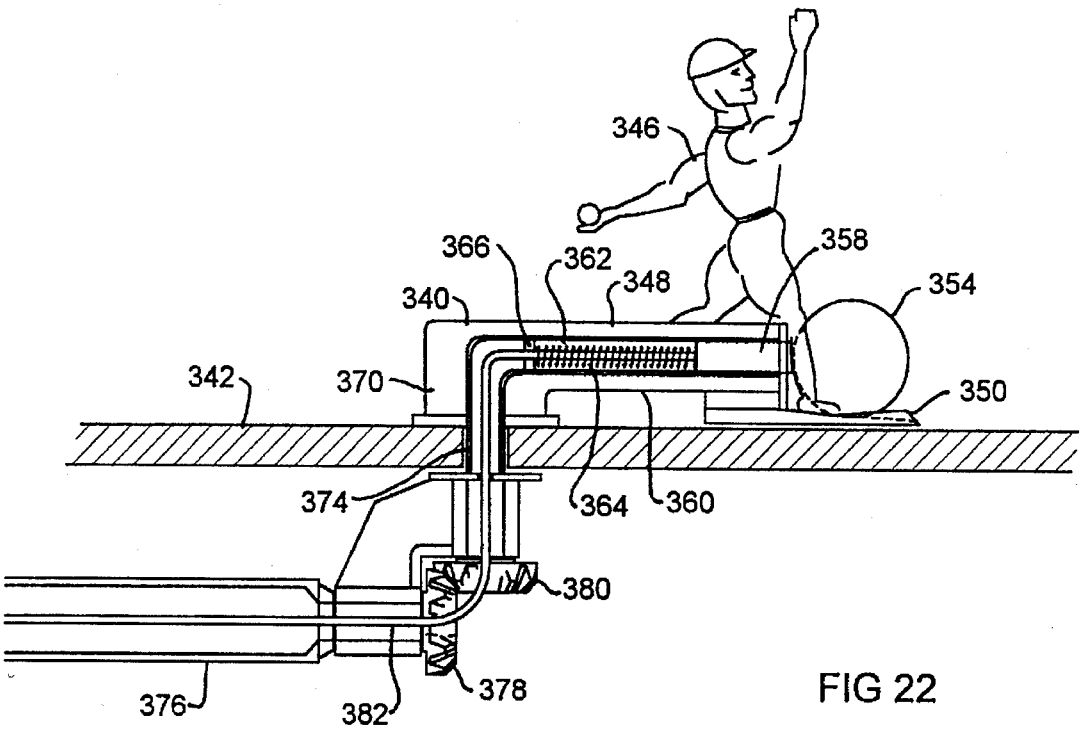
FIG. 22 is a detail view, in elevation and partly in cross-section, illustrating a bowling member for a board game simulating the sport of cricket or a pitcher for a baseball board game.
Figure 23:
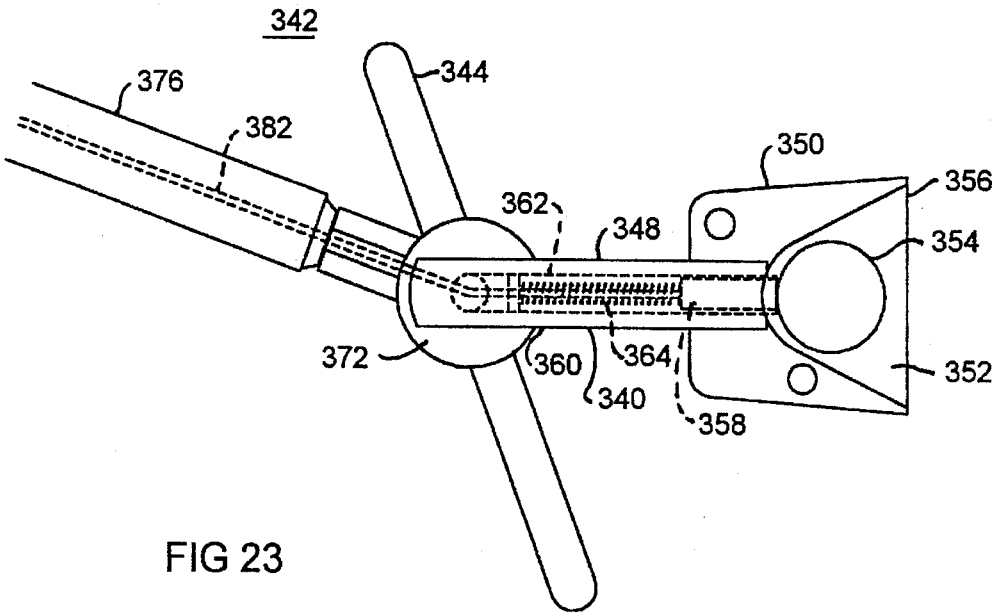
FIG. 23 is at top view of the bowling member of FIG. 22 but without the human figure for ease of illustration.

FIGS. 22 and 23 illustrate a movable playing member that can be used in a simulated game of cricket, this playing member 340 acting as the bowler, that is the player that throws the ball toward the batsman. This playing member could also be used as a pitcher in a simulated baseball game. Again, the playing member is designed to be mounted on a suitable game board 342 that has a slot 344 formed therein for the horizontal sliding movement of the bowler. As shown in FIG. 22, the playing member 340 preferably includes a human figurine 346 but this figurine has no separate movement apart from the movement of the base member 348 on which it is mounted. The figurine 346 can be rigidly mounted on top of a horizontal plate 350 which is an extension of the base member 348. Preferably a shallow recess 352 is formed in plate 350 in order to receive and temporarily hold a small ball 354. The recess opens towards the front edge 356 of the plate.

The ball 354 can be struck or rolled towards the batsman by means of a movable striking member 358 which is in the form of a pin member. The preferred base member in this embodiment includes a tubular section 360 that extends generally horizontally and that has a central passageway 362 to hold and guide the pin. There are also means for biasing the pin member in a direction towards the ball located in recess 352. The preferred biasing means is a coil spring 364. Art annular shoulder or stop 366 is formed in the passageway and the rear end of the spring presses against this shoulder.

The base member 348 has a short, downwardly extending, rear section 370 that includes a circular bottom flange 372. As in the earlier described embodiments, a hollow shaft 374 extends downwardly from the base member and is sized to extend through the slot 344 in the game board. Art elongate tube or rod 376, only a portion of which is shown, is used to move this playing member relative to the game board. Two bevelled gears 378 and 380 are again used to engage the tube 376 with the shaft 374 so that rotation of the tube about its longitudinal axis causes a corresponding rotational movement of the shaft. A flexible control line 382 extends through the tube and the shaft and into the base member 348. This line is connected at its inner end to the rear end of the pin member 358 and thus acts to hold the pin member in the passageway against the force of the coil spring. As in the earlier embodiments, the line 382 has means at the outer end of the tube 376 to enable the control line to be pulled and thereby pull the pin member 358 further into the passageway (away from the ball). When one releases the pull knob at the outer end of the line, the pin member is pushed quickly in the direction of the ball by the spring, thus causing the ball to roll in the direction of the batsman.

A preferred form of the basketball game of the invention employs a game board measuring 30 inches by 18 inches and it is shaped and patterned like a basketball court. The basket rim is preferably 3 inches above the playing surface. A preferred height for the backboard is 10 cm from bottom to top.

In addition to the illustrated means for detachably connecting the two board sections, one also can employ standard screws with suitable screw holes, the use of which will strengthen the connection. One can also employ clips to attach the board sections. It will also be appreciated that by making the two sections substantially identical, one can reduce the mold costs because the same mold can be used to mold each game board section 44, 46. Also, the preferred illustrated construction of the game board sections with the slots reaching the center line permits the slider or vertical shaft for each playing member to be easily slid into the open end of each slot, thus reducing consumer assembly time as compared to previously known systems.

Note that the present invention is also adaptable to make simulated board games similar to the games of soccer, baseball, cricket, football and golf. In the game of soccer, the pivoting manipulating portion of each playing member would represent the legs or leg of each soccer player. In a game of simulated baseball, the batting player could be made to operate in a manner similar to the above described hockey player except that the pivot axis for the upper portion of the batter's body and the bat would extend at an angle (such as 45 degrees) to the horizontal plane. In the game of football, the players would resemble those used in the game of basketball, in that the players could throw, catch and move with the ball. Of course, the slots in the board would have a configuration that simulated the movement around the field made by real players and enable blocks and tackles to be made. In the game of golf, the players would operate in a similar manner to the ice hockey player described above with a simulated golf club or putter substituted for a hockey stick. In the game of cricket, the batting player could also operate in a manner similar to the above described ice hockey player with a flat sided bat substituted for the hockey stick.

Various modifications and changes to the described embodiments will be readily apparent to those skilled in this art. Accordingly, all such modifications and changes are intended to be part of this invention.

We claim:

1. A board game apparatus comprising a game board with a generally flat, upwardly facing playing surface, a number of game playing members adapted to manipulate a small object for movement over or above said surface, each playing member including a body portion that extends upwardly from said playing surface and an object manipulating portion pivotally connected to said body portion, means for pivoting said manipulating portion relative to said body portion, a hollow shaft extending from each of said body portions and down through a slot in said playing surface for rotatably mounting the respective body portion on said playing surface, a number of substantially horizontal, rotatable tubes provided for moving said playing members along respective slots formed in said playing surface, means for engaging each tube with a respective vertical shaft so that rotation of each tube about its longitudinal axis causes a corresponding rotation of the shaft engaged therewith, said pivoting means including a flexible control line extending through each tube and its respective shaft and into said body portion, said line being connected at its inner end to said manipulating portion and having means located at an outer end of the respective tube to enable the line to be pulled, and means for rotatably supporting each tube below said playing surface, wherein rotation of each tube about its longitudinal axis rotates its respective playing member about a generally vertical axis.

2. A game apparatus according to claim 1 wherein said means to enable the line to be pulled is a movable control knob slidably mounted at said outer end of the tube.

3. A game apparatus according to claim 2 wherein said manipulating portion includes two spaced-apart arm sections each having an inner end and an outer end, a ball engaging device connected to said arm sections at the outer ends thereof, and a horizontal shaft section extending between and connecting said arm sections at the inner ends thereof, the inner section of said control line being connected to said shaft section.

4. A game apparatus according to claim 2 wherein said manipulating portion includes an elongate striking member having a narrow vertically extending section and an end section extending parallel to said playing surface, said elongate striking member located entirely on one side of said vertical axis extending through said shaft, and a pivot pin projecting from a vertical side of said manipulating portion located away from said elongate, striking member.

5. A game apparatus according to claim 2 wherein said control line has a thinner section where the line bends upwardly from an inner end of said tube to said shaft, the remainder of the line being substantially thicker.

6. A game apparatus according to claim 5 wherein said control line is made of molded acetal.

7. A game apparatus according to claim 1 including said small object to be manipulated, said object comprising a small, sponge rubber ball and wherein said game board has a basket member with an open bottom at each of two opposite ends thereof, said basket member being elevated above said playing surface.

8. A game apparatus according to claim 1 wherein said engaging means comprises a first gear mounted on each shaft below the playing surface and a second gear fixedly mounted on an inner end of said tube, each second gear operatively engaging the first gear of the respective playing member.

9. A combination movable playing member and control mechanism therefor suitable for a board game, said combination comprising a main body section and a pivotable body section connected to said main body section, the two sections comprising the playing member, a hollow shaft extending downwardly from said main body section and sized to extend through a hole in a game board for said game, elongate tube means for moving said playing member along a game board, means for engaging said tube means with the shaft so that rotation of said tube means about its longitudinal axis causes a corresponding rotational movement of the shaft, and a flexible control line extending through said tube means and said shaft and into said main body section, said line being connected at its inner end to said pivotable body section and having means located at the other end of said tube means to enable said control line to be pulled.

10. The combination according to claim 9 wherein said engaging means comprises a first gear mounted on said shaft and a second gear fixedly mounted on an inner end of said tube means, the second gear operatively engaging the first gear.

11. The combination of claim 10 wherein said first and second gears are bevel gears and said combination of the playing member and control mechanism includes a tube support member having a short passageway in which said one end of said tube means is rotatably mounted, said support member being itself supported by said shaft.

12. The combination of claim 9 wherein said enabling means is a movable knob slidably mounted on a short guide member attached to said tube means at said other end thereof.

13. The combination of claim 12 wherein said control line has a thinner section where the line bends upwardly between said one end of said tube means and the shaft, the remainder of said line being substantially thicker.

14. The combination of claim 13 wherein said control line is made of molded acetal.

15. The combination of claim 12 including spring biasing means connected between said main body section and said pivotable body section in order to bias said pivotable body section towards a selected normal position.

16. The combination of claim 9 wherein said pivotable body section includes two spaced-apart arm sections each having an inner end and an outer end, a ball engaging device connected to said arm sections at the outer ends thereof, and a horizontal shaft section extending between and connecting said arm sections at the inner ends thereof, said inner end of the control line being connected to said shaft section.

17. The combination of claim 9 wherein said pivotable body section has an elongate striking member having a narrow vertically extending section and an end section adapted to extend parallel to a playing surface of said game board, said elongate striking member located entirely on one side of a central axis of said shaft, and a horizontal pivot pin connects said pivotable body section to said main body section.

18. A combination movable playing member and control mechanism therefor suitable for a board game, said combination comprising a base member and a movable striking member mounted to or in said base member, said base member and said striking member comprising the playing member, a hollow shaft extending downwardly from said base member and sized to extend through a hole in a game board along a elongate tube means for moving said playing member relative to the game board, means for engaging said tube means with the shaft so that rotation of said tube means about its longitudinal axis causes a corresponding rotational movement of the shaft, and a flexible control line extending through said tube means and said shaft and into said base member, said line being connected at its inner end to said movable striking member and having means at the other end of said tube means to enable said control line to be pulled and thereby pull said striking member in one direction, and means for biasing said striking member to move in a direction opposite to said one direction.

19. The combination according to claim 18 wherein said base member includes a tubular section that extends generally horizontally, said striking member is a pin member slidable mounted in said tubular section, and said biasing means is a coil spring arranged in said tubular section rearwardly of said pin member, and wherein said line extends through said coil spring and is connected to a rear end of said pin member.

* * * * *

UNITED STATES PATENT AND TRADEMARK OFFICE

CERTIFICATE OF CORRECTION

PATENT NO. : 5,655,767

DATED : AUGUST 12, 1997

INVENTOR(S) : GEOFFREY V. FRANCIS ET AL

It is certified that error appears in the above-indentified patent and that said Letters Patent is hereby corrected as shown below:

Claim 18, column 16, line 24, after "board" insert a comma and delete "along a".

Claim 18, column 16, line 25, delete "relative to the" and insert --along a--.

Signed and Sealed this

Fifteenth Day of December, 1998

Bruce Lehman

*Attest:*

BRUCE LEHMAN

*Attesting Officer*

*Commissioner of Patents and Trademarks*